US005119667A

United States Patent [19]

Hollis et al.

[11] Patent Number: 5,119,667

[45] Date of Patent: Jun. 9, 1992

[54] PNEUMATIC HAMMER APPARATUS

[76] Inventors: Freddy C. Hollis, Rte. 1, Box 74, Ethel, Miss. 39067; John R. B. Poe, 418 Marilyn Dr., Pearl, Miss. 39208

[21] Appl. No.: 719,149

[22] Filed: Jun. 21, 1991

[51] Int. Cl.[5] ..... B21D 1/12

[52] U.S. Cl. ..... 72/453.16; 72/705

[58] Field of Search ..... 72/453.16, 453.17, 705; 173/134; 81/124.6

[56] References Cited

U.S. PATENT DOCUMENTS

| | | | |
|---|---|---|---|
| 885,985 | 4/1908 | Dunlap | 173/134 |
| 2,346,532 | 4/1944 | Borm | 72/453.16 |
| 2,526,380 | 10/1950 | Mathews | 173/134 |
| 2,547,224 | 4/1951 | MacGuire | 173/134 |
| 2,655,901 | 10/1953 | Brown | 173/134 |
| 4,222,294 | 9/1980 | Bippus | 81/177 R |

FOREIGN PATENT DOCUMENTS

| | | | |
|---|---|---|---|
| 234687 | 6/1960 | Australia | 173/134 |

*Primary Examiner*—Lowell A. Larson

*Attorney, Agent, or Firm*—Leon Gilden

[57] ABSTRACT

A pneumatic hammer for use on auto body surfaces to remove bumps and dents. The hammering force is developed by a piston that operates in an air cylinder; a compression spring drives the piston on its return stroke, such that the piston reciprocates rapidly back and forth to develop a hammering force. Interchangeable hammering elements are selectively retained on a non-circular head structure formed on the outer end of a piston rod. Ball detents extend from side faces of the head structure to lock the hammering elements onto the head structure.

11 Claims, 4 Drawing Sheets

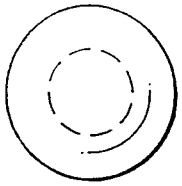
Fig 13
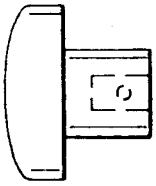
Fig 14
Fig 15
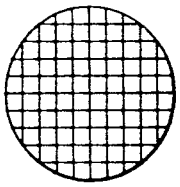
Fig 16
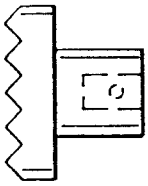
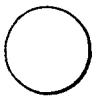
Fig 17
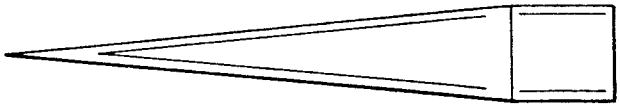
Fig 18
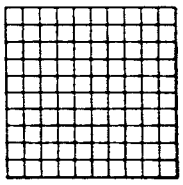
Fig 19
Fig 20
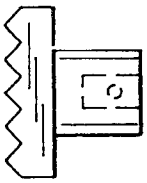
Fig 21
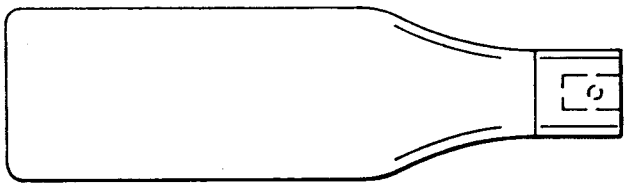
Fig 22
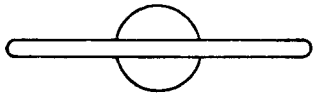
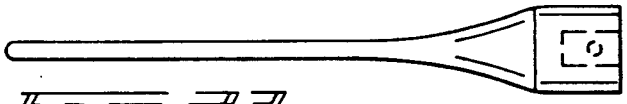
Fig 23
Fig 24
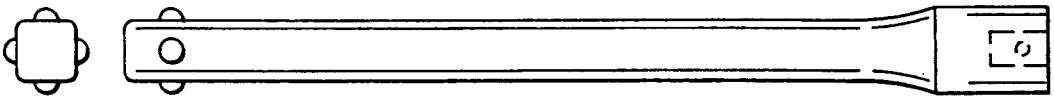
Fig 25

PNEUMATIC HAMMER APPARATUS

RELATED APPLICATIONS

This application is an improvement over application Ser. No. 07/444,846 now abandoned.

BACKGROUND OF THE INVENTION

Field of the Invention

This invention relates to a pneumatic hammer adapted for use on auto body surfaces to remove dents, bumps, creases and other surface irregularities.

Under conventional auto body repair practice, dents and creases are often removed from auto body surfaces with wooden handled hammers. The repairman pounds the auto fender or other auto body surface while holding a metal dolly (anvil) behind the auto body component. This is a slow, physically-tiring process. Unless the repairman is very skilled or has many years experience, it is difficult to apply uniform evenly distributed hammering pressure across the dented surface. In many cases the process is complicated by the lack of space in which to swing the hammer.

The present invention contemplates a small pneumatic hammering tool that takes up a relatively small space in the direction of the hammering axis. The hammering tool includes a manually-operable air passage restrictor mechanism that can be used to vary the flow rate of the pressurized air admitted to the air cylinder in the tool, such that the hammering force can be varied without changing the air supply pressure.

Actual hammer force is delivered by one of several hammering elements that may be selectively attached to a head structure formed on the end of a piston rod that extends from the hammering tool. These hammering elements have differently contoured hammer surfaces, e.g. flat, convexly rounded, concavely rounded, conical pick point, etc., such that hammering tools can be used to correct (eliminate) various different types of auto body surface irregularities.

SUMMARY OF THE INVENTION

In view of the foregoing disadvantages inherent in the known types of pneumatic hammers now present in the prior art, the present invention provides a pneumatic hammer apparatus wherein the same is arranged for use on auto body surfaces to remove dents. As such, the general purpose of the present invention, which will be described subsequently in greater detail, is to provide a new and improved pneumatic hammer apparatus which has all the advantages of the prior art pneumatic hammers and none of the disadvantages.

To attain this, the present invention provides a pneumatic hammer for use on auto body surfaces to remove dents. The hammering force is developed by a piston that operates in an air cylinder; a compression spring drives the piston on its return stroke, such that the piston reciprocates rapidly back and forth to develop a hammering force. Interchangeable hammering elements are selectively retained on a non-circular head structure formed on the outer end of a piston rod. Ball detents extend from side faces of the head structure to lock the hammering elements onto the head structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pneumatic hammer apparatus which has all the advantages of the prior art pneumatic hammers and none of the disadvantages.

It is another object of the present invention to provide a new and improved pneumatic hammer apparatus which may be easily and efficiently manufactured and marketed.

It is a further object of the present invention to provide a new and improved pneumatic hammer apparatus which is of a durable and reliable construction.

An even further object of the present invention is to provide a new and improved pneumatic hammer apparatus which is susceptible of a low cost of manufacture with regard to both materials and labor, and which accordingly is then susceptible of low prices of sale to the consuming public, thereby making such pneumatic hammer apparatus economically available to the buying public.

Still yet another object of the present invention is to provide a new and improved pneumatic hammer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is an orthographic frontal view of the fifth tool utilized by the invention.

FIG. 14 is an orthographic side view of the fifth tool utilized by the invention.

FIG. 15 is an orthographic frontal view of a sixth tool utilized by the invention.

FIG. 16 is an orthographic side view of the sixth tool utilized by the invention.

FIG. 17 is an orthographic frontal view of a seventh tool utilized by the invention.

FIG. 18 is an orthographic side view of the seventh tool utilized by the invention.

FIG. 19 is an orthographic frontal view of the eighth tool utilized by the invention.

FIG. 20 is an orthographic side view of the eighth tool utilized by the invention.

FIG. 21 is an orthographic top view of a ninth tool utilized by the invention.

FIG. 22 is an orthographic end view of the ninth tool utilized by the invention.

FIG. 23 is an orthographic side view of the ninth tool utilized by the invention.

FIG. 24 is an orthographic frontal view of an extension tool utilized by the invention.

FIG. 25 is an orthographic side view of the extension tool utilized by the invention.

DESCRIPTION OF THE PREFERRED EMBODIMENT

Figure 1:
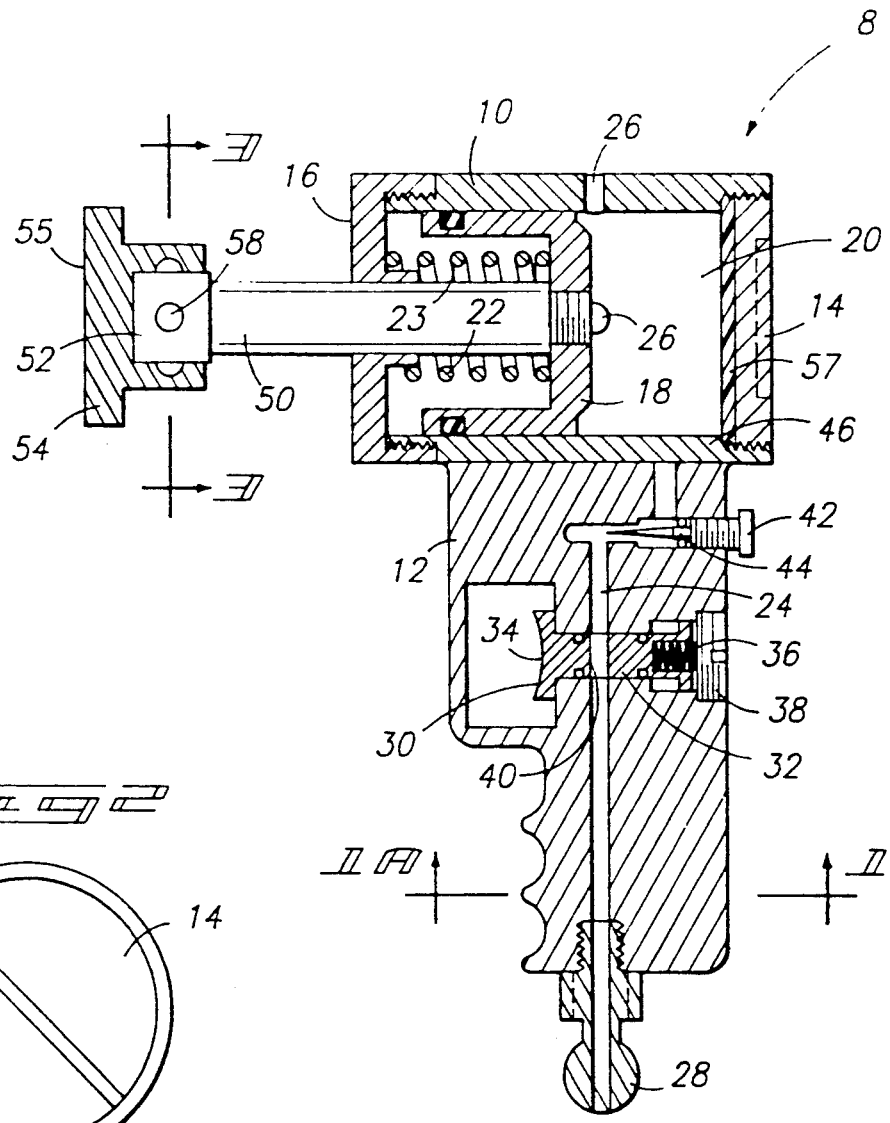
FIG. 1 is a cross-sectional view, taken through a pneumatic hammer of the invention.
Figure 2:
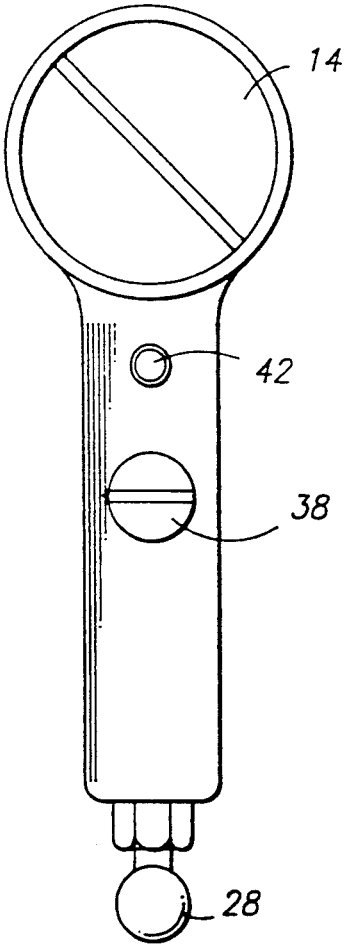
FIG. 2 is an orthographic rear view of the invention.
Figure 1A:
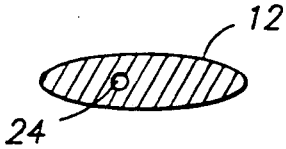
FIG. 1*a* is an orthographic cross-sectional illustration, taken along the lines 1*a*—1*a* of FIG. 1.
Figure 3:
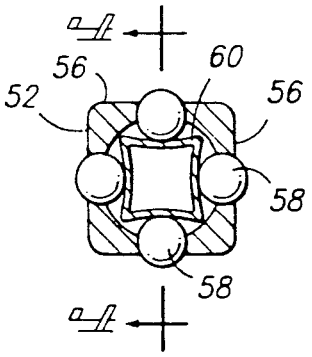
FIG. 3 is an orthographic view, taken on the line 3—3 of FIG. 2 in the direction indicated by the arrows.
Figure 4:
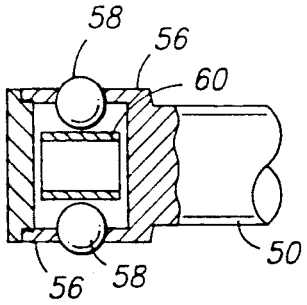
FIG. 4 is an orthographic view, taken along the lines 4—4 of FIG. 3 in the direction indicated by the arrows.
Figure 5:
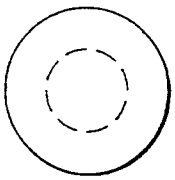
FIG. 5 is an orthographic front view of a first tool utilized by the invention.
Figure 6:
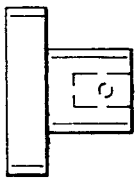
FIG. 6 is an orthographic side view of the first tool utilized by the invention.
Figure 7:
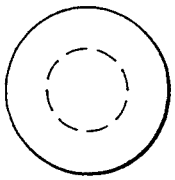
FIG. 7 is an orthographic frontal view of a second tool utilized by the invention.
Figure 8:
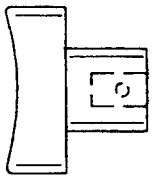
FIG. 8 is an orthographic side view of the second tool utilized by the invention.
Figure 9:
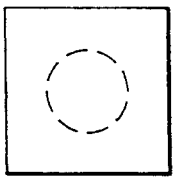
FIG. 9 is an orthographic frontal view of a third tool utilized by the invention.
Figure 10:
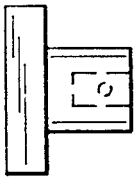
FIG. 10 is an orthographic side view of the third tool utilized by the invention.
Figure 11:
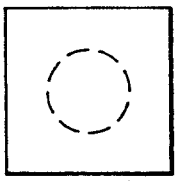
FIG. 11 is an orthographic frontal view of a fourth tool utilized by the invention.
Figure 12:
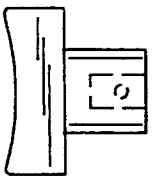
FIG. 12 is an orthographic side view of the fourth tool utilized by the invention.
Figure 26:
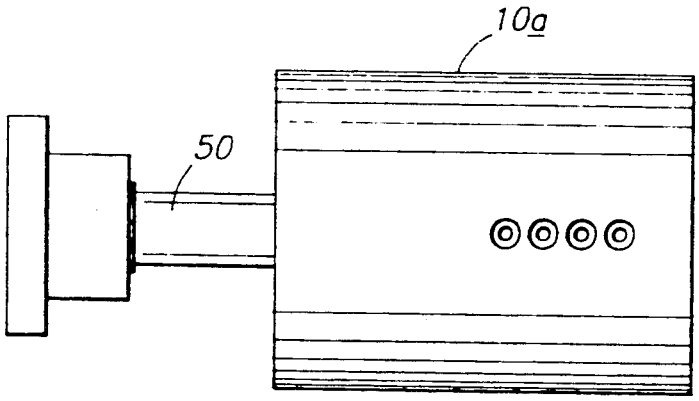
FIG. 26 is an orthographic top view of a modification of the air cylinder tube utilized by the invention.
Figure 27:
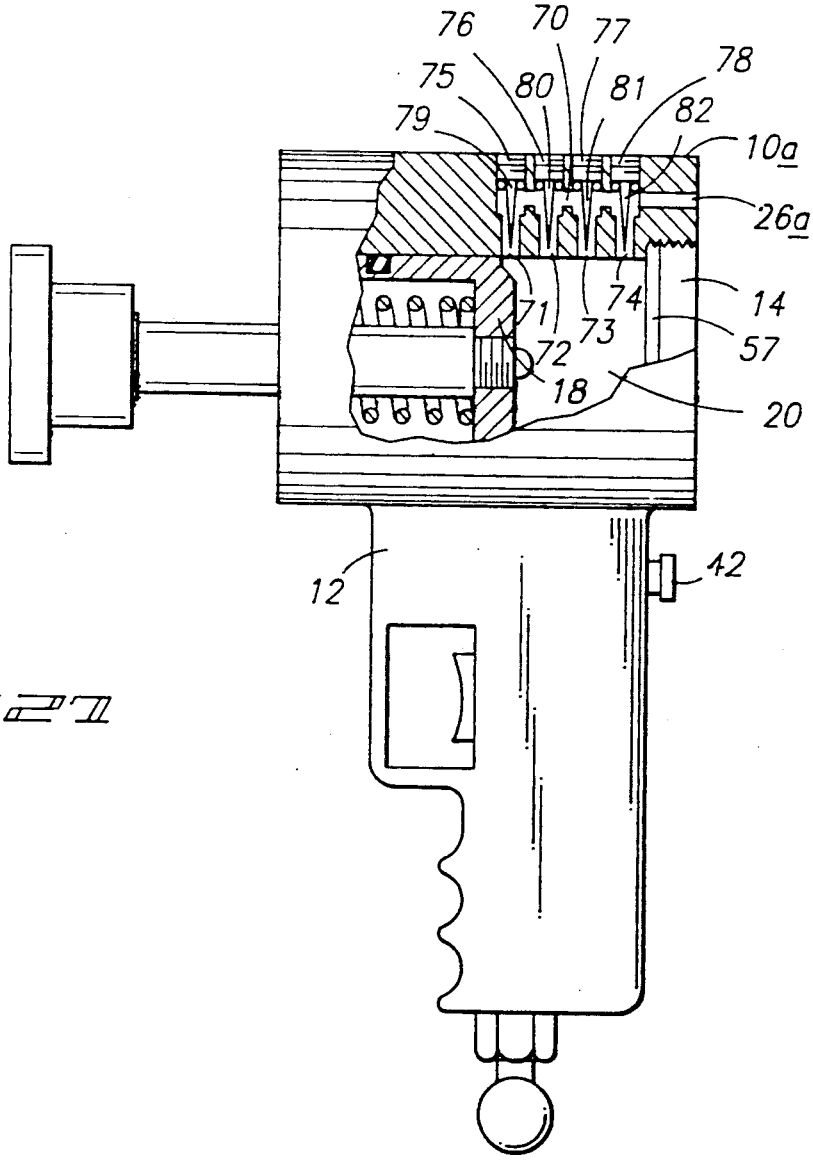
FIG. 27 is an orthographic side view of the modified air cylinder tube, partially in section, illustrating the various internal components thereof.

With reference now to the drawings, and in particular to FIGS. 1 to 27 thereof, a new and improved pneumatic hammer apparatus embodying the principles and concepts of the present invention and generally designated by the reference numeral 8 will be described.

The drawings show a pneumatic hammer mechanism 8 that includes an air cylinder tube 10 attached to a handle 12 of a generally elliptical cross-sectional configuration. Opposite ends of the cylinder tube are closed by an externally threaded rear end wall 14 and forward end wall 16. The rear end wall 14 is threadedly received within the rear end portion of the air cylinder tube 10 to permit volumetric increasing or decreasing of the air chamber 20 to accordingly modify the pressurized availability effected to the piston 18 through the air passage means 24. A piston 18 is slidably positioned within the tube 10 to subdivide the cylinder space into an air chamber 20 and a spring chamber 22.

Compression coil spring 23 is trained between end wall 16 and piston 18 for biasing the piston rightwardly away from wall 16. Compressed air is supplied to chamber 20 for moving piston 18 leftwardly toward end wall 16. An air passage means 24 within handle 12 supplies compressed air chamber 20. Air is exhausted from chamber 20 through a single vent port 26 located at a point approximately midway along tube 10.

Air supply passage means 24 includes an air fitting 28 adapted to connect with an air supply hose, not shown. The compressed air flows upwardly from fitting 28 through a drilled passage in handle 12. Air flow can be stopped (halted) by a manually-controlled valve 30. Valve 30 includes a cylindrical plunger (rod) 32 that is slidably positioned within a bore that runs transverse to the vertical air passage in handle 12. One end of plunger 32 is connected (affixed) to a manual trigger 34. The other end of the plunger is engaged with a compression spring 36 that seats against the left face of a screw-in plug 38.

Plunger 32 is shown in a deflected position achieved by manual depression of trigger 34. A hole 40 in the plunger is aligned with the vertical passage sections to transmit pressurized air upwardly through the defined air passage. Release of manual pressure on trigger 34 allows spring 36 to shift plunger 32 leftwardly to a position in which air flow through the passage system is stopped.

A manually adjusted restrictor mechanism 42 is located in air supply passage means 24 downstream from manual valve 30, i.e. above valve 30 in FIG. 1. The restrictor mechanism comprises a needle valve element 44 having a threaded shank portion threaded into a threaded opening in handle 12. The needle end of element 44 extends through a relatively large diameter passage into a relatively small diameter passage; the juncture between these passages forms an annular shoulder. Manual advancement of valve element 44 in a leftward direction reduces the size of the annular flow space between the needle element surface and the annular shoulder; rightward motion of element 44 increases the size of the flow space.

Restriction mechanism 42 can be adjusted to vary the air flow rate through passage means 24 without varying the air supply pressure at the air source (tank).

Air passage means 24 terminates in an air pressure port 46 located in tube 10 in close proximity to end wall 14. Introduction of pressurized air into chamber 20 (via port 46) causes piston 18 to move leftwardly against the biasing action of spring 23. As the rightmost edge of piston 18 reaches vent port 26, the pressurized air is vented out of chamber 20. The flow area of port 26 is preferably greater than the flow area established by restrictor mechanism 42.

Taking into account the pressure differentials, chamber 20 will be depressurized, thereby permitting spring 23 to drive piston 18 rightwardly toward end wall 14.

When the air vent port means 26 is closed by the piston side surface, the pressurized air flowing through port 46 will begin to effectively repressurize chamber 20. When the air pressure force overcomes the spring force, the piston will reverse its motion back toward end wall 16. As long as trigger 34 is held in a depressed condition, piston 18 will reciprocate back and forth within the air cylinder. FIG. 1 shows piston 18 at or near the end of its leftward travel (and hence near the beginning of its rightward travel).

The velocity of piston 18 in the leftward direction is related to the air flow rate through port 46; the greater the air flow rate the greater will be the leftward velocity of the piston. Adjustment of restrictor mechanism 42 can be used to vary the leftward velocity of piston 18, and hence the hammering force of element 54.

Piston 18 is attached to a piston rod 50 that extends through end wall 16. The left end of rod 50 forms a square cross-sectioned head 52 that is adapted to interchangeably receive any one of a number of differently contoured hammering elements; one such hammering element is designated by numeral 54 in FIG. 1. Each hammering element will have a square shaped socket opening sized to snugly fit onto head 52. Replacement of one hammering element with another hammering element is accomplished by manually pulling one element off of head 52 and pushing another element onto the head.

The illustrated hammering element 54 has a flat hammering surface 55. Other hammering elements will have differently contoured hammering surfaces, e.g. round convex (FIG. 14), round concave (FIGS. 8 and 12), serrated hammering surface (FIGS. 15 and 19), conical pick point (FIG. 18), chisel plate (FIGS. 21), etc. For areas difficult to reach directly, an extension rod (FIG. 25) may be slipped onto head 52; the appropriate hammering element will be fitted onto the remote (left) end of the extension element.

Head 52 is a hollow structure having a square cross-section that defines four flat exterior faces 56. Four spherical balls 58 are floatably positioned within head 52 so as to project through circular openings in head faces 56. A thin-walled tube 60 formed of a springy material (e.g. hardened steel) is centrally positioned within head 52 to exert an outward biasing force on balls 58; tube 60 has a generally square cross-section, but with its outer surfaces slightly concave. The tube walls can deflect inwardly in response to pressure applied to the tube walls by balls 58.

Each hammering element will have a square cross-sectioned socket sized to snugly fit onto (around) head 52. Circular depressions will be formed in the socket surfaces to mate with the projecting portions of balls 58. During the process of inserting each hammering element onto head 52, balls 58 will be deflected radially onto head 52; when the circular depressions in the socket surfaces register with balls 58, the balls will snap outwardly into the depressions, thereby firmly retaining the hammering element on head 52.

The use of four radially-movable balls 58 is thought to be an especially good method of retaining a hammering element on piston rod 50; hammering (reciprocating) motions of the hammering element are effectively handled so that the hammering element remains firmly attached to the piston rod.

A principal feature of the invention is the construction of air cylinder tube 10, whereby hammer mechanism 8 has a relatively small dimension in the hammering direction, i.e. along the axis of piston rod 50. Air cylinder tube 10 may be relatively short, on the order of three or four inches; the stroke of the associated piston 18 may be at least five eighth inches. The desired axial compactness is achieved partly by the fact that spring 23 extends into piston 18, i.e. piston 18 is of hollow construction. Also, port 46 is located in close proximity to end wall 14, such that piston 18 has a relatively long stroke distance (for a given length cylinder).

During normal operation piston 18 does not come into contact with end wall 14. However, at shutdown (release of trigger 34) spring 23 can force the piston into contact with wall 14. Also, if restrictor mechanism 42 is set at a low flow rate, the piston can possibly contact end wall 14. In order to minimize noise and shock loads under such conditions, the interior face of end wall 14 can have a layer of semi-resilient plastic material 57 thereon. Plastic layer 57 is considered an optional feature of the invention.

A modified air cylinder tube **10*a* includes a modified vent port 26*a* projecting through the air tube 10*a* above the externally threaded end wall 14. A vent port manifold 70 is in pneumatic communication with the vent port 26*a* and the air chamber 20 through a series of inlet conduits defined by a first, second, third, and fourth inlet conduit 71, 72, 73, and 74 respectively. Each of these inlet conduits includes a coaxially aligned valve defined by a respective first, second, third, and fourth valve 75, 76, 77, and 78. Each of the first through fourth valves includes a respective first, second, third, and fourth conical valve projections 79, 80, 81, and 82 projecting into each respective inlet conduit of the first through fourth inlet conduits to effect modulation of air directed therethrough. The staged array of inlet conduits permits fine tuning of air exhausted through action of the piston 18. For example, by closure of the second through fourth valves, the first valve is opened and the second through fourth valves effects interference of exhausting air, as opposed to opening the fourth valve alone permitting a relatively uninterrupted exhausting of air during the pneumatic hammering procedure. Further, dependent upon the opening of the first through fourth valves, the piston 18, as illustrated in the forward orientation, will uncover the first valve lastly and the fourth valve initially, whereby opening of selective valves permits a further means of controlling the piston stroke of the organization by requiring the piston to travel a varying amount coaxially of the tube 10*a*** dependent upon which of the first through fourth valves is opened.

It should be further noted in this regard that the inlet conduits 71–74 are linearly aligned relative to one another and extend orthogonally between the first end wall or forward end wall 16 and the rear end wall 14 defining a second end wall.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pneumatic hammer for use on auto body surfaces, comprising:

an air cylinder tube;

a handle extending angularly from said air cylinder tube;

a piston slidably positioned within the cylinder to subdivide same into an air chamber and a second chamber;

a first end wall closing said second chamber;

a compression coil spring in said second chamber trained between said first end wall and said piston for urging said piston away from said first end wall;

a piston rod extending from said piston through said first end wall;

said piston rod having a non-circular head adapted to interchangeably receive any one of a number of differently contoured hammering elements;

a second end wall closing said air chamber, said second end wall threadedly received within a rear end portion of the air cylinder tube permitting volumetric adjustment of the air chamber;

an air supply passage means extending through said handle, said air supply passage means terminating in an air pressure port in the air cylinder tube in rear proximity to said second end wall;

and an air vent port in said air cylinder tube adjacent said second end wall;

and a manually controlled valve carried on said handle for stopping the flow of air through said air supply passage means.

2. The pneumatic hammer of claim 1 further comprising a manually adjusted restrictor means in said air supply passage means, whereby the flow rate through the passage means can be varied without varying the air supply pressure.

3. The pneumatic hammer of claim 2 wherein said restrictor means comprises a needle valve having a threaded area threaded into the handle on an axis parallel to the air cylinder tube axis.

4. The pneumatic hammer of claim 1 wherein said manually controlled valve comprises a plunger slidably mounted within the handle for movement parallel to the air cylinder tube axis, a manual trigger connected to one end of said plunger, and a compression spring operatively connected to the other end of said plunger.

5. The pneumatic hammer of claim 4 further comprising a transverse hole through the plunger oriented to align with the air supply passage means only when the trigger is manually depressed.

6. The pneumatic hammer of claim 5 wherein said noncircular head is a hollow structure having a square cross-section that defines four flat exterior faces extending parallel to the piston rod axis, four spherical balls floatably oriented within the hollow head structure so that one ball projects through each flat face of the head structure, and a spring tube centrally positioned in the hollow head structure in pressure engagement with the four balls for biasing said balls away from the piston rod axis.

7. The pneumatic hammer of claim 6 wherein said spring tube has an essentially square cross-section, with the outer surfaces thereof slightly concave.

8. The pneumatic hammer of claim 7 wherein said coil spring telescopes into the piston to minimize the overall length of the air cylinder tube.

9. The pneumatic hammer of claim 8 wherein said air vent port is in pneumatic communication with an air vent port manifold contained within the air cylinder tube, and the air vent port manifold in pneumatic communication with the air chamber, and a linearly aligned plurality of valve members projecting through the air cylinder tube into the air vent port manifold, each of the valves including a valve projection, and each valve projection coaxially aligned within an inlet conduit, and each inlet conduit in communication with the air chamber.

10. The pneumatic hammer as set forth in claim 9 wherein the inlet conduits are linearly aligned and extend orthogonally between the first end wall and the second end wall.

11. The pneumatic hammer as set forth in claim 10 wherein the non-circular head is arranged to selectively receive one of a plurality of hammer members, wherein each hammer member includes a varying hammering face.

* * * * *